United States Patent [19]

Haytayan

[11] 4,339,065

[45] Jul. 13, 1982

[54] PNEUMATIC TOOL

[76] Inventor: Harry M. Haytayan, Sunnyside La., Lincoln, Mass. 01773

[21] Appl. No.: 129,713

[22] Filed: Mar. 12, 1980

Related U.S. Application Data

[63] Continuation of Ser. No. 927,296, Jul. 24, 1978, abandoned.

[51] Int. Cl.[3] ..... B25C 1/04; B25C 7/00

[52] U.S. Cl. ..... 227/8; 227/15; 227/32; 227/43; 227/48; 227/113; 227/120

[58] Field of Search ..... 227/8, 15, 16, 17, 18, 227/26, 30, 31, 32, 35, 37, 43, 48, 99, 100, 112, 113, 120, 130

[56] References Cited

U.S. PATENT DOCUMENTS

| | | | |
|---|---|---|---|
| 2,048,930 | 7/1936 | Hansen et al. | 227/43 |
| 2,310,008 | 2/1943 | Wolff et al. | 227/48 |
| 3,298,584 | 1/1967 | Miller | 227/113 |
| 3,595,460 | 7/1971 | Pitkin | 227/48 |
| 3,612,378 | 10/1971 | Pabich et al. | 227/120 X |
| 3,734,377 | 5/1973 | Munn | 227/120 |

FOREIGN PATENT DOCUMENTS

| | | | |
|---|---|---|---|
| 2240233 | 2/1974 | Fed. Rep. of Germany | 227/120 |
| 1377808 | 12/1974 | United Kingdom | 227/120 X |

*Primary Examiner*—Paul A. Bell
*Attorney, Agent, or Firm*—Schiller & Pandiscio

[57] ABSTRACT

A novel device is disclosed for driving nail-like fasteners with associated washers into a workpiece. The device comprises a pneumatic driver apparatus, preferably one substantially the same as the tool disclosed in U.S. Pat. No. 4,040,554, in association with a washer dispenser apparatus capable of semiautomatically deploying washers from a washer magazine so that the washers are fixed to the workpiece by the heads of the fasteners. The pneumatic driver and washer dispenser are attached together as a discrete assembly which is mounted on a hanger assembly so as to appear substantially weightless to a tool operator, and the driver and dispenser are adapted to be activated by a remotely positioned trigger device.

16 Claims, 19 Drawing Figures

PNEUMATIC TOOL

This is a continuation of my copending application Ser. No. 927,296, filed July 24, 1978 for Pneumatic Tool now abandoned.

FIELD OF INVENTION

This invention relates to pneumatic driving apparatus in general and more particularly to a new type of fastener driving tool.

BACKGROUND OF THE INVENTION

Present methods of commercial steel production generally call for forming giant steel ingots from an initial melt by pouring the liquid metal into a mold, and later utilizing these ingots during subsequent manufacturing operations. It is generally desired that these ingots be formed substantially free of large voids.

It is well known in the steel industry that the undesired large voids appear in the ingot if premature solidification takes place in the region of the upper edges of the mold while the mold is still being filled or while the metal in the center of the mold is still molten. This premature solidification must therefore be prevented if substantially void-free ingots are to be cast. The typical method of preventing this solidification is to apply a liner of suitable insulation, generally available in the industry under the names Hot-Top and Riser, to the inside surface of the mold at its upper end. The insulation acts to prevent heat loss through the mold at its upper end, thereby assuring that the melt will not prematurely freeze on the mold. The preferred manner of attaching the insulation to the mold is to fasten it on by means of nail-like fasteners, with the point of the fastener penetrating the insulation and fixing itself in the wall of the mold and the head or shank of the fastener engaging the washer which in turn engages the insulation liner and holds it firmly against the mold.

Unfortunately, there have been a number of difficulties associated with this fastening technique. First, the heavy cast iron molds used in casting the ingots have proven more impervious to fastener penetration than ordinary steel. As a result, very high power impact drivers have been required to set the fasteners. Second, the very nature of the fastening job has dictated that the impact drivers be highly mobile and light in weight so as to facilitate fastening. And third, it has been found to be highly preferable to deploy the fastener with a washer spaced between the head of the fastener and the insulation liner so as to prevent the fastener from excessively penetrating the insulation.

To date, only explosive-activated impact drivers have come close to satisfying these requirements. Unfortunately, these devices are also relatively slow in operation, expensive, dangerous to operate, and suffer from substantial noise and recoil problems. In addition, these devices require that the operator manually position a preassembled washer/fastener in the front end of the barrel of the gun one at a time and the explosive charge above the fastener. This manual loading of the washer/fastener and the explosive charge slows down the operation of the tool. Furthermore the lack of an adequate handle and trigger extension has added significant problems to utilizing these tools around the giant (e.g. 5'×4'×10') cast iron molds previously described, e.g. operators have been required to work in an awkward position when attaching the insulation to the mold.

As a result, one of the objects of the present invention is to provide a device for attaching insulation to cast iron molds which is substantially free of the problems facing explosive-activated impact tools.

Another object is to provide means for adapting a pneumatic fastener driver of the type shown in U.S. Pat. No. 4,040,554 for attaching insulation to cast iron molds.

Yet another object is to provide means for automatically deploying a washer with the fastener as part of the normal operation of the tool, without the operator having to manually position a washer/fastener for each fastening operation.

Still another object is to produce a fastening device which is relatively light in weight and has a high degree of mobility.

And another object is to provide a fastening tool which has a handle and trigger extension for using the tool in hard-to-reach locations.

SUMMARY OF THE PRESENT INVENTION

These objects, and other objects hereinafter disclosed or rendered obvious, are achieved by providing a fastener driver in association with a washer dispenser apparatus for driving fasteners and associated washers as one into a workpiece, with the washers being fixed to the workpiece by the heads of the fasteners. The driver and the washer dispenser are adapted to be mounted on a hanger assembly so as to appear substantially weightless to a tool operator, and the driver and washer dispenser are further adapted to be activated by a remotely positioned trigger device.

THE DRAWINGS

Figure 1:
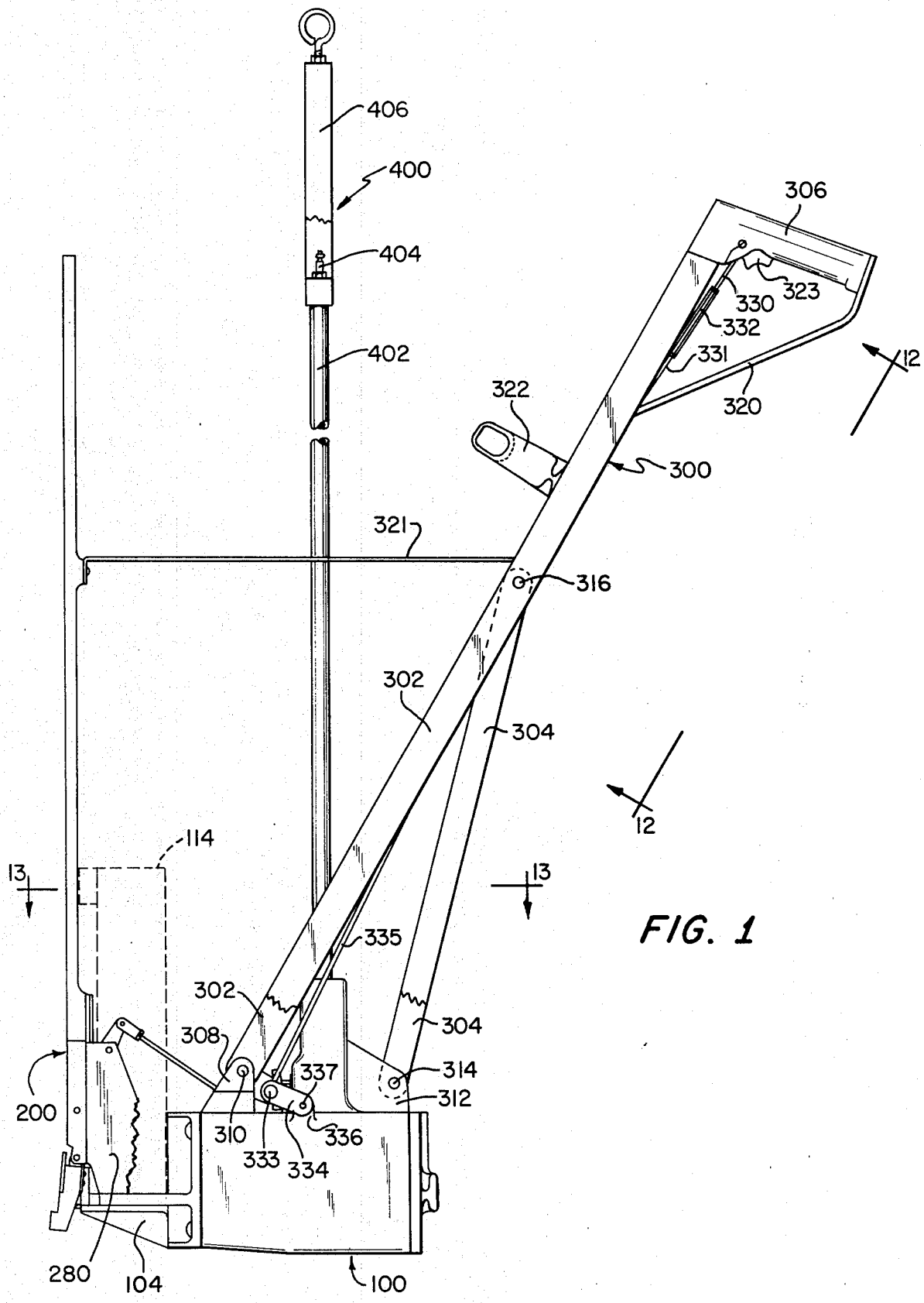
FIG. 1 is a side view in elevation showing the left side of the preferred form of the fastener driving tool, with selected portions broken away.
Figures 4, 5, 8, 9:
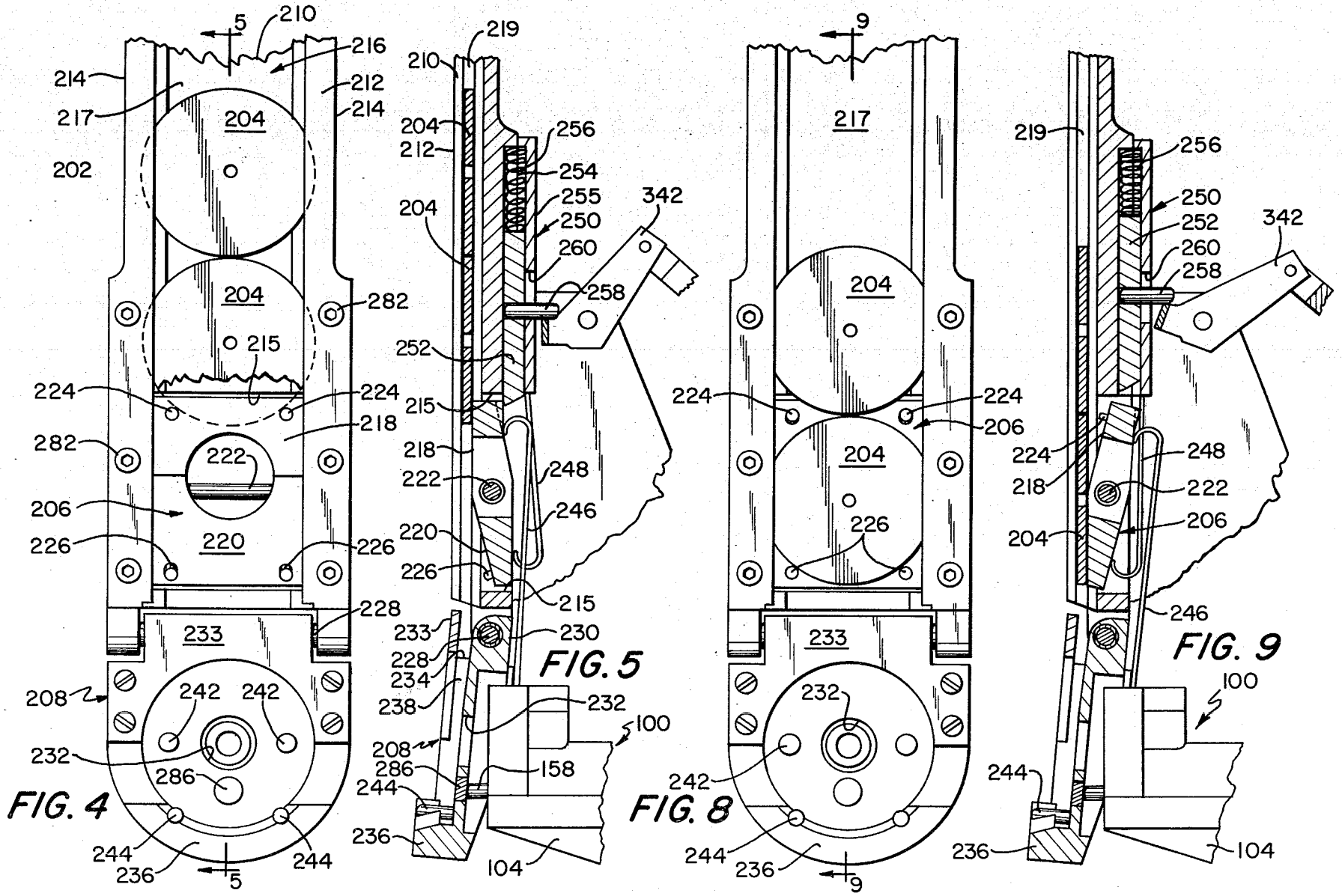
FIGS. 4, 8 and 10 are enlarged partial views of the front side of the washer dispenser, showing the dispenser and associated washers in different positions.
Figure 12:
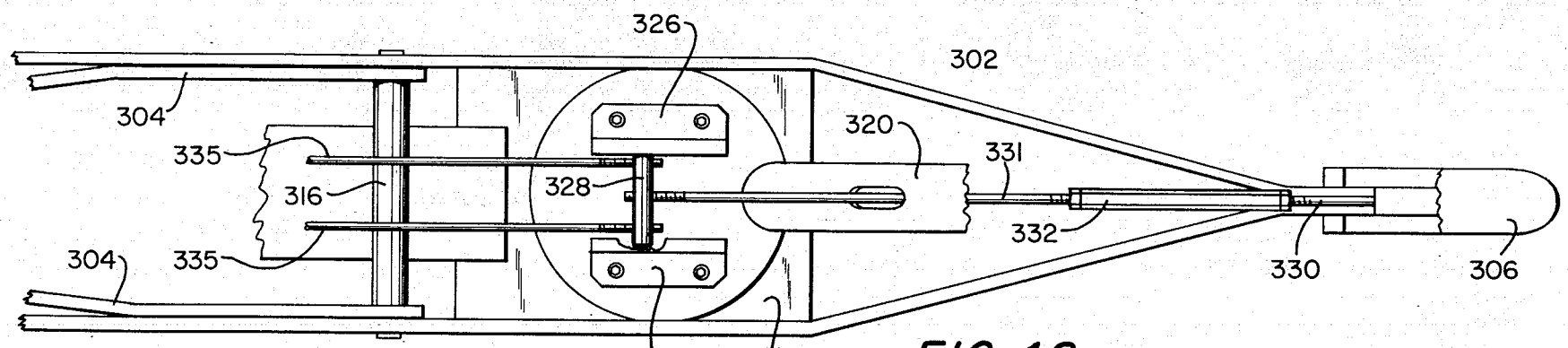
Figure 6:
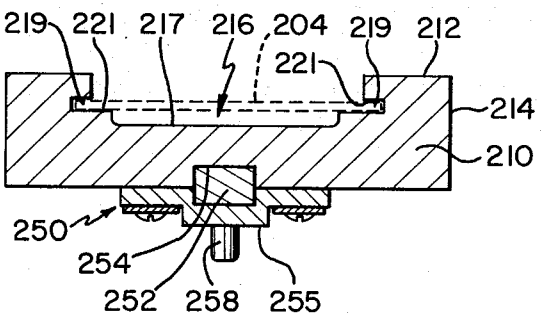
Figure 7:
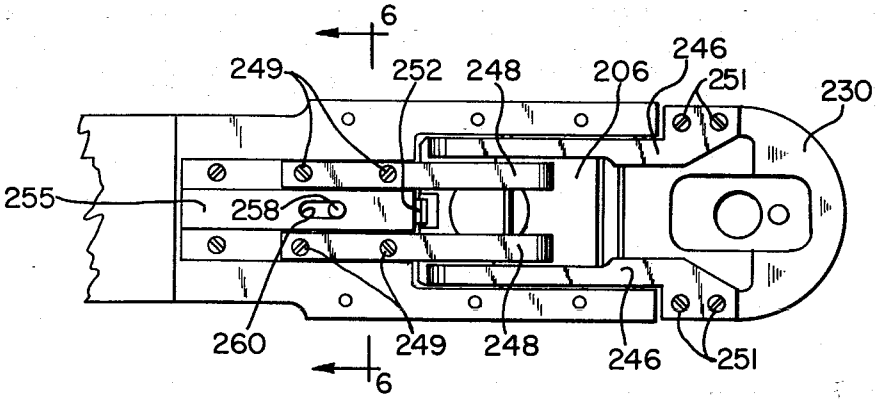
Figure 11:
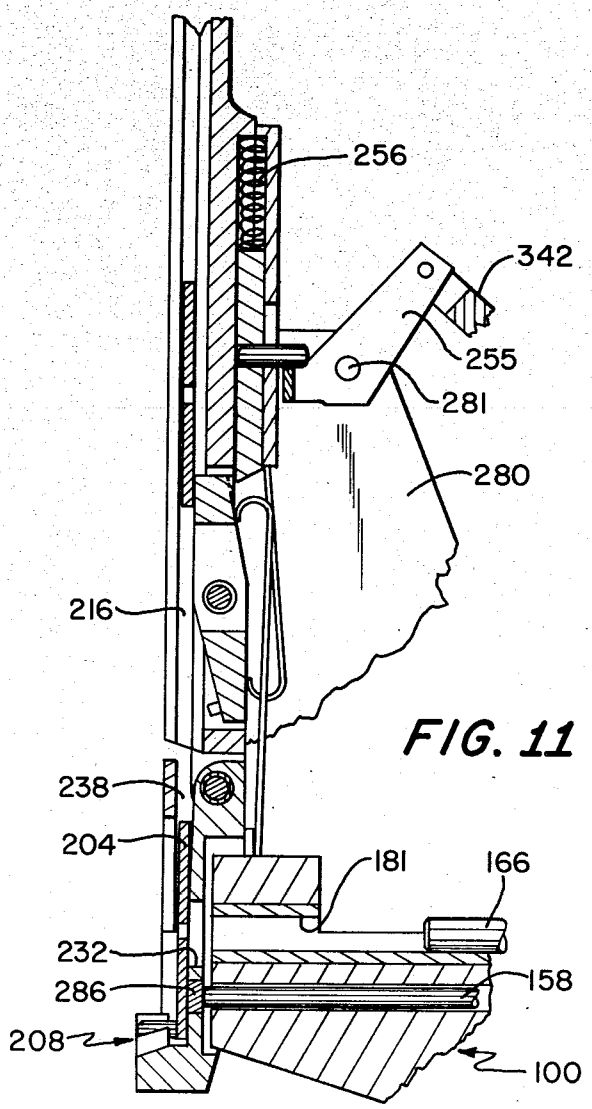
Figure 10:
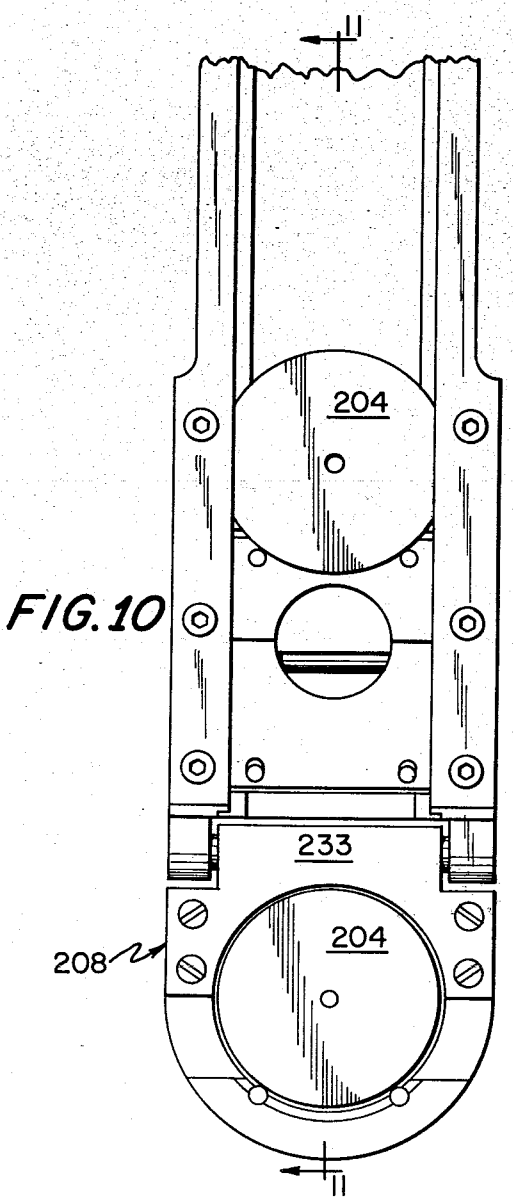
Figure 14:
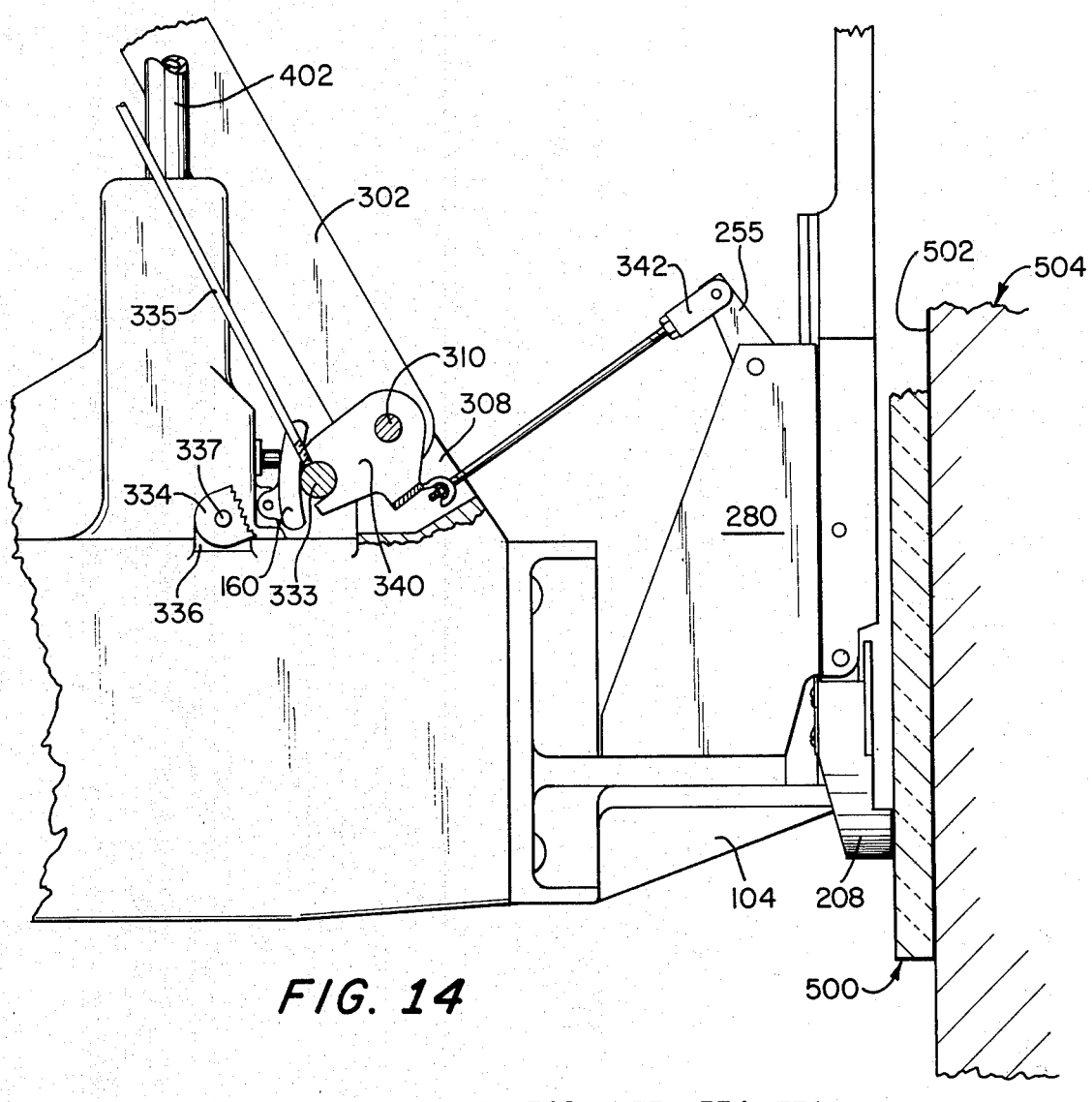
Figure 13:
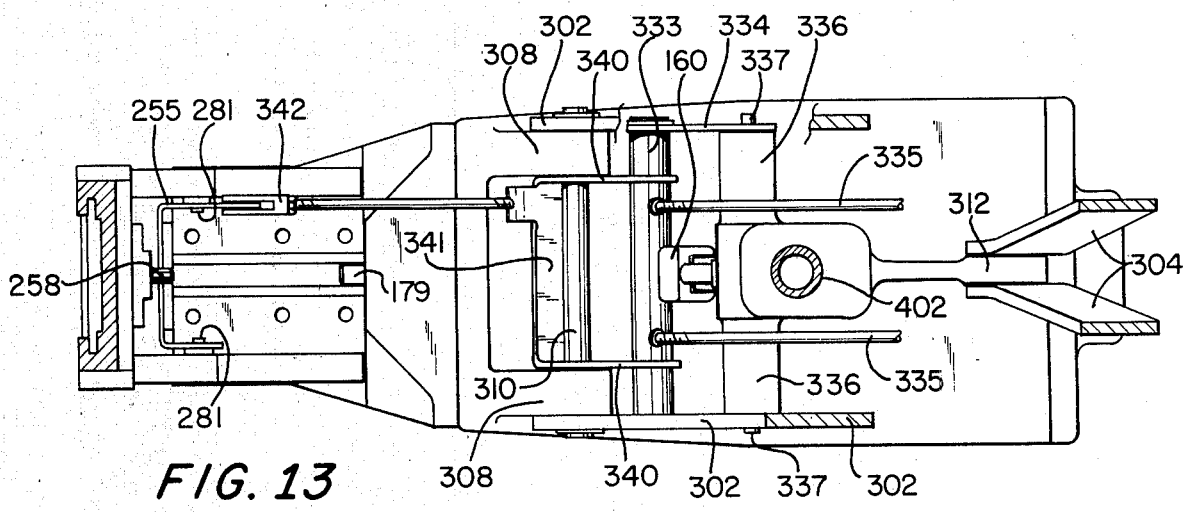
Figure 15:
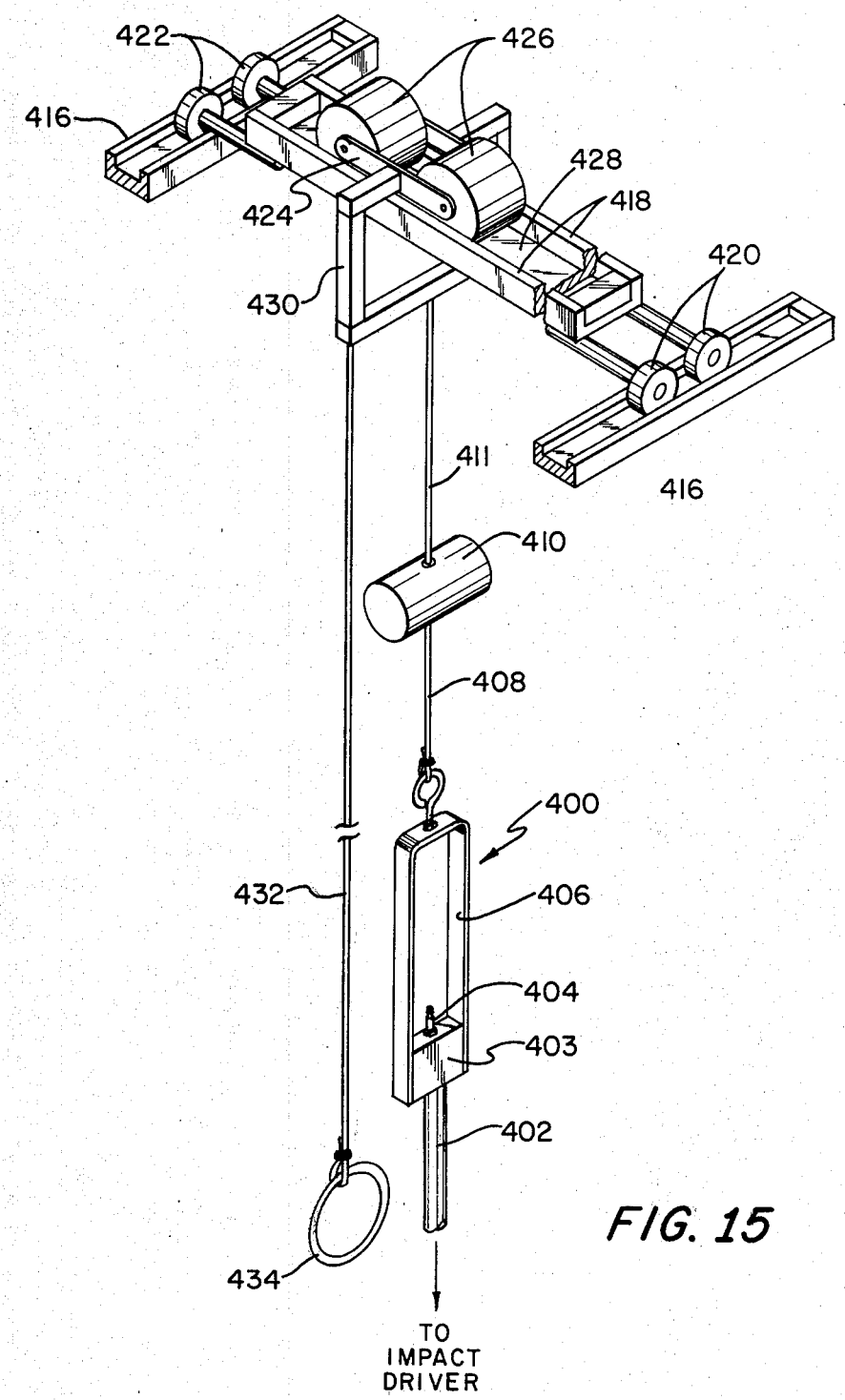
Figure 17:
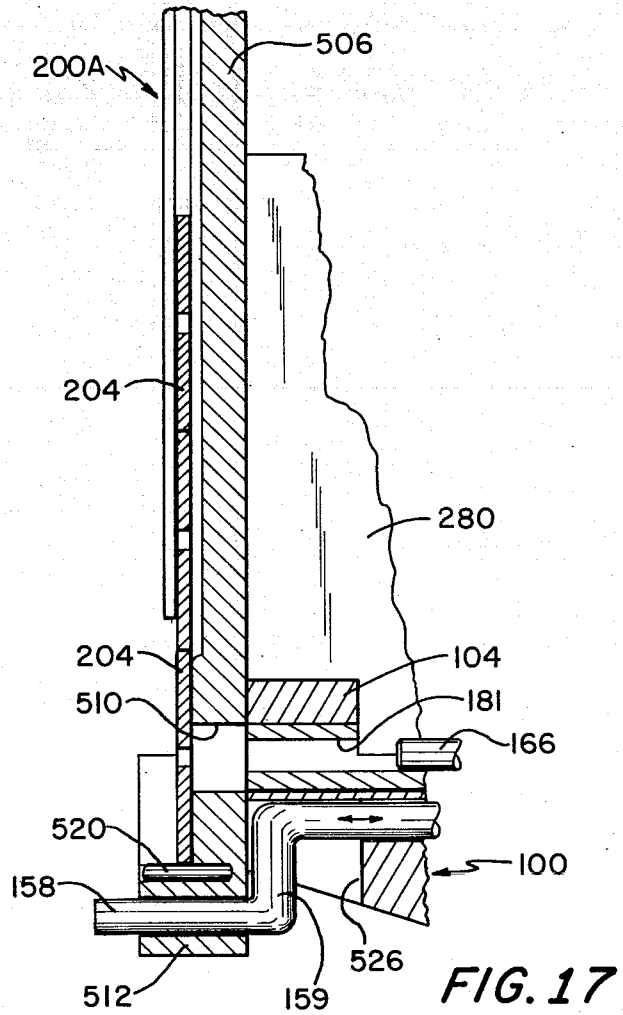
Figure 16:
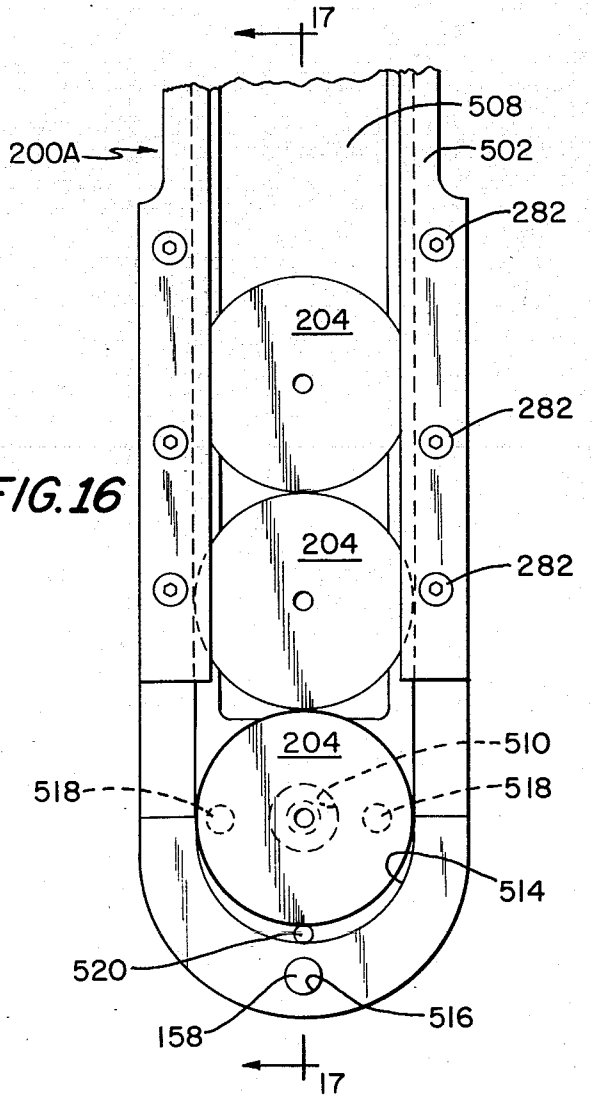

FIGS. 5, 9 and 11 are cross-sections of the washer dispenser taken along lines 5—5, 9—9, 11—11 of FIGS. 4, 8 and 10 respectively;

FIG. 6 is a cross-section of the washer dispenser taken along line 6—6 of FIG. 7;

FIG. 7 is a partial view of the rear side of the washer dispenser;

FIG. 12 is an enlarged partial view of the handle assembly, as taken from the viewpoint of line 12—12 of FIG. 1;

FIG. 13 is a top plan view of the tool taken along line 13—13 of FIG. 1;

FIG. 14 is an enlarged, partial side view showing the right side of the tool against a workpiece, with selected portions broken away;

FIG. 15 is a perspective view illustrating a mechanism for mounting the tool for use;

FIG. 16 is an enlarged partial view of the front side of a modified washer dispenser; and FIG. 17 is a cross-sectional view taken along line 17—17 of FIG. 16.

In the several views, like members are identified by the same numerals.

DESCRIPTION OF THE PREFERRED EMBODIMENT

Referring first to FIG. 1, the fastener driving tool is generally comprised of a pneumatic driver 100 for driving the fasteners, a washer dispenser 200 for semiautomatically positioning the washers where they may be engaged by the fasteners, a handle assembly 300 for positioning the tool relative to the workpiece and activating it, and a support assembly 400 whereby the device may be hung so as to be substantially weightless in mid-air.

Figures 2, 2A:
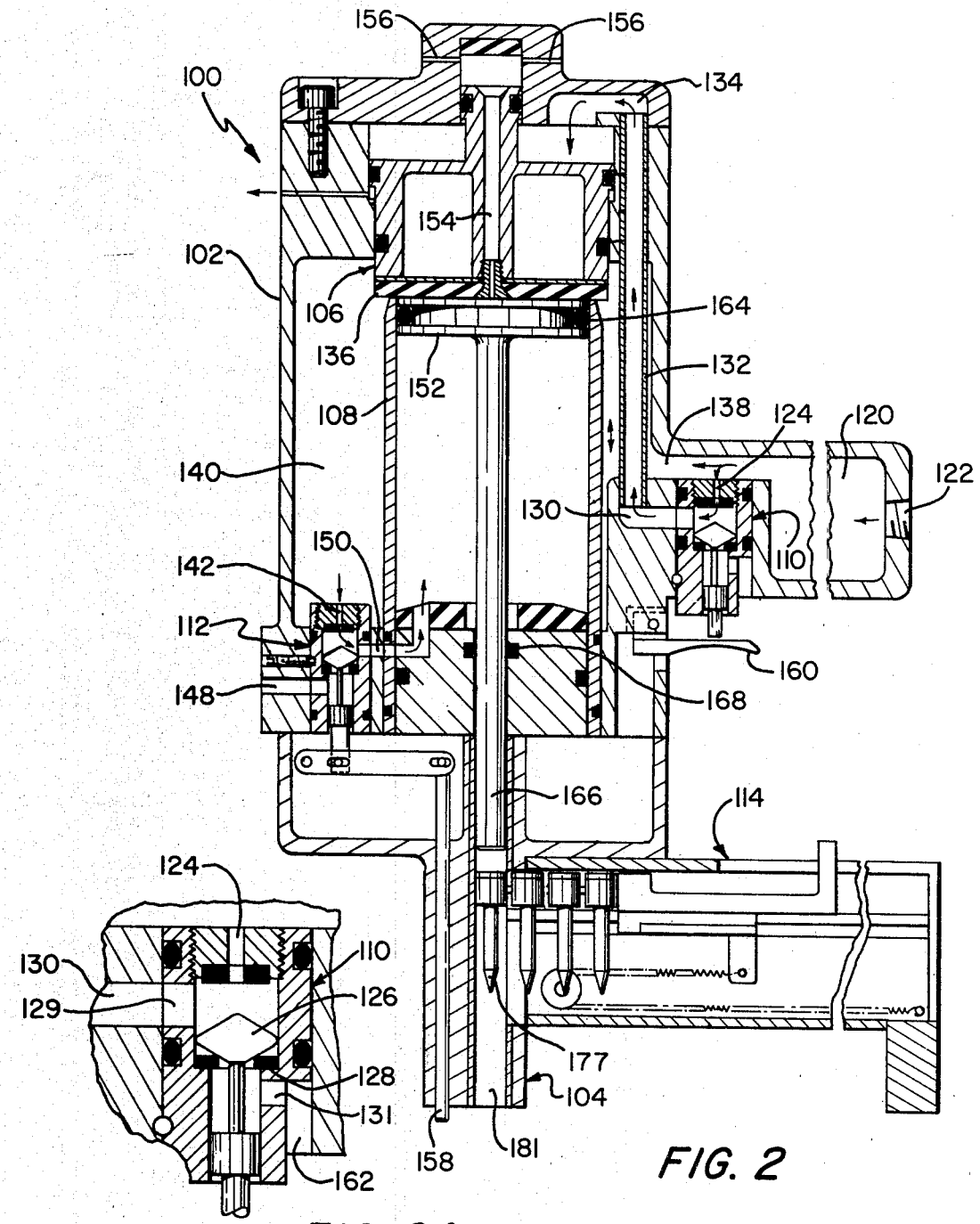
FIG. 2 is a sectional view of a preferred form of pneumatic driver usable in the present invention, showing the driver with its hammer in a retracted or ready position.
FIGS. 2A and 2B are enlarged views of portions of FIG. 2.
Figures 2B, 3:
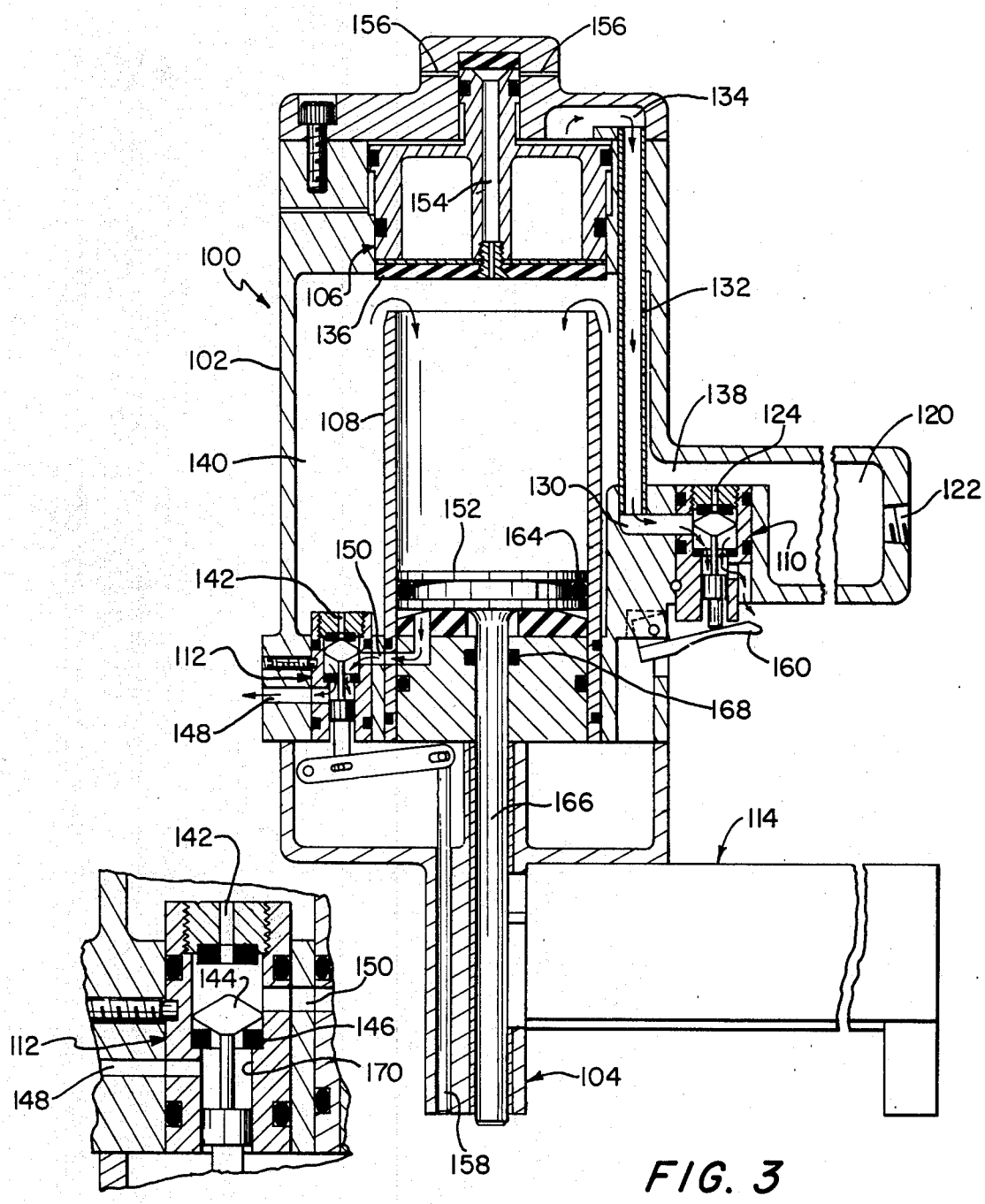
FIG. 3 is a view like that of FIG. 2 showing the same driver with the hammer at the completion of its drive stroke.

Pneumatic driver 100 is shown in greater detail in FIGS. 2, 2A, 2B and 3. Driver 100 and its accompanying fastener magazine are substantially the same as the corresponding mechanisms disclosed in U.S. Pat. No. 4,040,554, except that their housings have been modified slightly to incorporate them into the present invention. Accordingly, they are described herein only to the extent believed necessary to understand and appreciate the present invention. Referring first to FIG. 2, driver 100 generally comprises an outer housing 102 having a bottom nozzle 104 and accommodating a poppet valve 106, a central cylinder 108, a control valve 110, and a safety valve 112. A fastener magazine 114 is mounted to nozzle 104. These members, in conjunction with related parts, are intended to operate as is hereinafter briefly described. First, pressurized air is supplied to the manifold chamber 120 by connecting inlet port 122 to a suitable supply of pressurized air, as will be described later. This air passes through the orifice 124 of valve 110 (FIG. 2A) and acts on a valve head 126 to close off the opening in a pad 128. The air passing through orifice 124 proceeds through an opening 129, a passageway 130 and a tube 132 into a chamber 134 where it applies a force to the upper end of a poppet valve 106, whereby the latter is urged to assume the position shown in FIG. 2 wherein the rubber disc 136 forms a tight seal with the upper edge of cylinder 108. Simultaneously air is supplied by passageway 138 to the air reservoir chamber 140 and proceeds through the orifice 142 (FIG. 2B) of a safety valve 112 to urge the valve member 144 down against pad 146 to prevent a discharge of air from exit passageway 148. The air entering the chamber of safety valve 112 also passes through a passageway 150 into the interior of cylinder 108, thereby providing a force on the underside of piston 152 which holds the piston up against the sealing disc 136 of poppet valve member 106. Any air trapped between the upper end of the piston 152 and the disc 136 is exhausted to the atmosphere via passageway 154 and vent ports 156. At this point the device is in its normal "primed" state, (FIG. 2) and it cannot be fired unless a safety mechanism actuator rod 158 is forced upwardly far enough for valve member 144 to unblock the opening in valve seat 146. If the trigger 160 should be squeezed while operating rod 158 is in the down position shown in FIG. 2, valve member 126 will change positions and the air pressure acting on the upper side of the poppet valve 106 is released by a discharge of air from chamber 134 via tube 132, The internal chamber in which valve member 126 is disposed, valve opening 131 and exit port 162. As a result, the pressure in reservoir 140 will then move poppet valve 106 up and thereby allow pressurized air to act on the upper end of piston 152. However, no movement of the piston will occur because an equilibrium force condition exists as a result of the opposing force of the pressurized air acting on the bottom surface of piston 152 and the additional static frictional forces due to the engagement of seal 164 with the cylinder 108 and the rod-like hammer 166 with stationary seal 168. If, however, safety mechanism actuator rod 158 is pushed far enough upwards so that valve member 144 now blocks off orifice 142 (FIG. 3) the air pressure acting on the underside of piston 152 is rapidly exhausted to the atmosphere by outflow of air via passageway 150, bore 170 and port 148. If the trigger 160 should now be squeezed so as to move the valve member 126 up far enough to close off orifice 124 while safety mechanisms actuator rod 158 is still pushed upwards (FIG. 3), poppet valve 106 will move up rapidly toward chamber 134 and the full line pressure in reservoir 140 will act on the upper end of piston 152 so as to cause the latter to move rapidly through its normal firing stroke so as to engage hammer 166 with a fastener 177 (advanced by magazine 114) and thereby drive it from the nozzle hole 181 of pneumatic driver 100. The piston 152 will not return to its normal starting position until the actuator rod 158 and trigger 160 are both released. Then the driver will be ready to fire again, a new fastener having been automatically loaded into the firing chamber by the fastener magazine 114. In the preferred embodiment described and illustrated herein the safety mechanism actuator rod 158 is adapted to yield under about 5 pounds of pressure.

Mounted to the front end of driver 100 is a washer dispenser 200 for semi-automatically positioning washers where they may be engaged by fasteners as the fasteners exit from the nozzle of driver 100. Washer dispenser 200 is shown in detail in FIGS. 1, 4–11 and 13 and 14. Referring first to FIGS. 4 and 5, the dispenser is shown to generally comprise a washer rack or magazine 202 for slidably storing one or more washers 204, a gate in the form of a pivot plate 206 for use in dispensing the washers from rack 202, and a washer holder 208 for holding a washer just prior to its engagement with a fastener.

Rack 202 is comprised of a long metal bar 210 having a flat front surface 212 and side surfaces 214. As shown in FIG. 6, a longitudinally-extending channel 216 is formed in front surface 212. Channel 216 is comprised of a floor 217 and side tracks 219 and has a cross-sectional profile as shown in FIG. 6. Side tracks 219 are properly sized so as to slidably constrain metal washers 204 along the length of bar 210. Referring now to FIGS. 4 and 5, the floor 217 of channel 216 is removed near the bottom of bar 210 so as to form an opening 215 in which a pivot plate 206 is positioned. Plate 206 is provided with front bevelled surfaces 218 and 220 and is adapted to pivot on a rod 222 whose ends are anchored in openings in the sides of bar 210, so that surfaces 218 and 220 can alternately be placed substantially flush with the bottom surfaces 221 (FIG. 6) of side tracks 219. Pivot plate 206 carries a pair of pins or projections 224 which extend perpendicularly outward from surface 218 and a pair of pins 226 which extend perpendicularly outward from surface 220, and pins 224 and 226 are sized so that (1) when surface 218 is substantially aligned with the surfaces 221 of channel 216, pins 224 may serve as a stop for washers 204 sliding along tracks 219; (2) when surface 220 is aligned with the surfaces 221 of tracks 219, pins 226 may serve as a stop for washers sliding along tracks 219; and (3) when either pair of pins intrudes into the path of the washers, the other pair of pins sits fully withdrawn from that path.

Washer holder 208 is pivotally attached to the bottom of bar 210 by means of a pin 228. Holder 208 comprises a base plate 230 and a cover plate 233, with the base plate having a central bore 232 with a diameter somewhat larger than that of the fasteners to be deployed, a counterbore 234 having a diameter somewhat larger than that of a washer, and a curved flange forming a toe 236. A washer channel 238 is provided between base plate 230 and its cover plate 233 in order that when channel 238 is suitably aligned co-planar (as hereinafter described) with the washer channel 216 formed in bar 210, a washer can be gravity fed along channel 216 and negotiated past pivot plate 206 into counterbore 234 of washer holder 208. A pair of steel pins 244 in plate 230 at toe 236 serve to absorb the force of the washers' fall and act as stops, and a pair of cylindrical magnets 242 are mounted into suitable bores in plate 230 so as to hold the washers in counterbore 234.

Pivot plate 206 is operated so as to regulate the advancement of washers from rack 202 into holder 208 by means hereinafter described. Two pairs of leaf spring members 246 and 248 and an activator mechanism 250 (FIGS. 4–7 and 11) are provided to cause pivot plate 206 to suitably rotate on rod 222 so as to allow the passage of washers 204 past the plate. Springs 248 are attached to the rear side of bar 210 by screws 249 and extend over the rear side of pivot plate 206, while springs 246 are attached to the rear side of base plate 230 by screws 251 and extend over the rear side of the same pivot plate. In the position shown in FIG. 5, springs 248 generate a greater pushing force on pivot plate 206 than springs 246, but when washer holder 208 is pressed inwards so that its channel 238 is aligned co-planar with the channel 216 in bar 210, the force of springs 246 will exceed the force of springs 248.

Still referring to FIGS. 4–7, activator mechanism 250 consists of a tongue 252 slidably disposed in a channel 254 formed in bar 210 and slidably retained by a plate 255 which is bolted to bar 210. Tongue 252 is urged downward toward washer holder 208 by a spring 256 which is captivated in channel 254, so that tongue 252 may extend over the rear edge of pivot plate 206 when surface 218 is aligned with surface 221 and thereby lock the pivot plate in the position shown in FIGS. 4, 5 and 7. A pin 258 is attached to tongue 252 and is adapted to slide in an elongated opening 260 in retainer plate 255. Hole 260 is arranged so as to allow the tongue to be manually urged back (by means hereafter described acting against pin 258) against spring 256 far enough to be disengaged from pivot plate 206. When this is done the pivot plate will automatically rotate to the position shown in FIGS. 8 and 9, due to the greater force of springs 248. The pivot plate may be rotated back to the position shown in FIGS. 4 and 5 by forcing holder 208 to an upright (flat) position (FIGS. 10 and 11) so that channels 216 and 238 align themselves and the force of springs 246 exceeds the force of springs 248. The rear side of the protruding portion of the tongue is suitably bevelled to allow the tongue to yield inwardly under this action.

The washer dispenser is designed to operate as follows. Assume that the mechanism is in a "load" position as shown in FIGS. 4 and 5. In this state holder 208 is at an angle to bar 210 and pivot plate surface 218 is substantially flush with the surface 221 of tracks 219. A plurality of washers 204 may then be fed into the top of channel 216, with gravity advancing the washers downward until pins 224 stop their advancement. Next the operator properly stimulates pin 258 (by means hereinafter described) to slide tongue 252 out of engagement with pivot plate 206, thereby allowing springs 248 to rotate the pivot plate on rod 222 and bringing the mechanism to a "ready" position, as shown in FIGS. 8 and 9. During this operation pins 224 are withdrawn from the path of the washers and pins 226 are projected into the path, thus allowing the washers to fall along rack 202 to their new position. Finally, the dispenser is put in a "firing" position by forcing holder 208 backwards into the position shown in FIGS. 10 and 11 so that channel 238 becomes aligned with channel 216 and pivot plate 206 is rotated again by springs 246 so as to again place its pins 224 in washer-intercepting position. As the plate rotates, pins 226 withdraw and the lead washer drops into counterbore 234, where it is retained by magnets 242 ready to be engaged by a fastener fired from driver 100.

Washer dispenser 200 is attached to driver 100 in the following manner. First a pair of support struts 280 are fastened to the nozzle 104 of driver 100, as shown in FIGS. 1 and 14. Then dispenser 200 is screwed to support struts 280 via screws 282 (FIG. 4). Dispenser 200 mounts to driver 100 in such a manner that when holder 208 is pressed inwards for alignment with washer rack 202, holder 208 contacts nozzle 104 and bore 232 in holder 208 lines up with the nozzle hole 181 (FIG. 11) of driver 100. A wear pin 286 (FIGS. 4 and 11) is mounted in washer holder 208 for contacting safety mechanism actuator rod 158 when holder 208 is forced backwards.

A handle assembly 300 is provided to facilitate the coordinated operation of driver 100 and washer dispenser 200, particularly in hard to reach places such as about the top edges of the large cast iron molds previously described. This handle assembly is shown in FIGS. 1 and 12–15 and generally comprises a pair of support bars 302, a pair of auxiliary support bars 304 and a handle 306. The lower ends of bars 302 are secured to ears 308 formed integral with the housing of driver 100 by means of a pin 310. Bars 302 angle upwards away from the driver, coming together near their upper ends and forming a single extension thereafter for attachment to handle 306. Auxiliary support bars 304 are in turn screwed to an ear 312 formed integral with the housing of driver 100 by means of a pin 314. Bars 304 extend upwards away from the driver and are joined to bars 302 intermediate their length by a pin 316. Bars 304 serve to fix support bars 302 firmly in position relative to driver 100.

Handle member 306 is attached at its top to the joined ends of rods 302 and a support strut 320 extends between one end of the handle and a support plate 317 (FIG. 12) which is mounted and secured to bars 302. A second support strut 321 extends between and is secured at its end to plate 317 and the washer magazine 200. In addition, a hand grip 322 may be fitted to support bars 302 above support strut 321.

Set into and pivotally mounted to handle member 306 is a trigger 323 which is adapted to activate the driver and washer magazine by means hereinafter described. Referring now to FIG. 12, mounted to the underside of support plate 317 are two mounts 326 which slidably constrain a pin 328. A pair of connecting rods 330 and 331 joined by a turnbuckle 332 serve to link trigger 323 to pin 328 so that the latter will slide along mount 326 when the trigger is depressed. Pin 328 is in turn coupled by means of a pair of rigid support rods 335 (FIGS. 1 and 13) to an actuator rod 333 which is pivotally mounted between a pair of arms 334 (only one of which is shown) that are in turn pivotally mounted to bosses 336 formed integral with opposite sides of the driver housing by means of pivot pins 337. Rod 330 is located in light contact with trigger 160. Pin 328, rods 332, rod 333 and arms 334 are positioned such that when pin 328 is moved up by depressing trigger 232, rods 332 will cause rod 330 and arms 334 to pivot on pins 337, thereby driving actuator rod 333 against driver trigger 160 so as to depress the latter. When the pull on trigger 323 is released, the return action of driver trigger 160 will cause the linkage members to work in reverse, thereby restoring trigger 323 to its original position. In this way, trigger 323 can be used to effectively operate driver 100.

As shown in FIG. 14, also engaged with actuator pin 333 is a yoke comprising side sections 340 which are mounted so as to be supported by and to pivot about pin 310 as pin 333 is rotated and a body section 341 which is attached to and operates a link 342. The latter is pivotally connected to one end of a U-shaped lever 255 which forms part of activator mechanism 250. Lever 255 is pivotally attached to struts 280 by pins 281 and is positioned to engage pin 258 (FIGS. 8 and 13) and serves to force the activator tongue 252 to slide upward along bar 210 each time trigger 323 is depressed. In this way, trigger 323 serves to activate washer dispenser tongue 252 as well as pneumatic driver 100.

The combined sub-assembly of pneumatic driver 100, washer magazine 200 and handle assembly 300 is intended to be weightlessly support in mid-air by a hangar assembly 400, as shown in FIGS. 1 and 15. Attached to the inlet port 122 of driver casing 102 is a rigid air pipe 402 which serves both to support the tool and deliver pressurized air to driver 100 via a fitting 404 which is coupled by an air hose (not shown) to a suitable source of pressurized air such as an air compressor (also not shown). Hangar assembly 400 comprises a block 403 which is affixed to and connects pipe 402 and fitting 404, and a hangar member 406 that is secured to block 403 and serves as a connector to a cable 408. The latter is connected by an automatic balancing mechanism 410 and a second cable 411 to a suitable support assembly which is adapted to permit the tool freedom of movement in two directions in a horizontal plane. The balancing mechanism 410 is a conventional apparatus well known to persons skilled in the art, one form of which is sold commercially under the tradename AERO-MOTIVE® BALANCER by Aero-Motive Mfg. Co. of Kalamazoo, Mich. Suffice it to state that cable 408 is wound on a spring-biased drum or wheel forming part of balancing mechanism 410 and is capable of being extended or retracted when the force of gravity on the tool is overcome by the operator pulling it down or pushing it up, and of remaining in any given position when the operater releases the tool. If desired the mechanism 410 could be modified so as to automatically raise the tool to a preset height each time it is released by the operator.

The support assembly may take various forms. By way of example but not limitation the support assembly may be a motorized crane. It also may be relatively light weight so as to be operable by hand. Thus, the support assembly may comprise a pair of parallel rails 416 which are fixed and may, for example, be suspended from the ceiling or roof structure of a steel mill, a main carriage 418 having wheels 420 and 422 which ride on rails 416, a secondary carriage 424 comprising wheels 426 which ride in a groove 428 in carriage 418, and a rigid depending yoke 430 which serves as a point of attachment for cable 411. A third cable 432 is attached to yoke 430 and provided with a suitable handle 434 at its bottom end. Cable 432 is used by the operator to move carriages 418 and 424 for the purpose of maneuvering the driver tool into the desired working position.

The installation and operation of the tool will now be described. First the tool is mounted to its support assembly, and an air hose is coupled to fitting 404 so that the driver is suitable energized with compressed air. Then a fastener magazine loaded with a fresh supply of fasteners is attached to the driver. Next the washer dispenser is manually put into its "load" position and a plurality of washers are fed into the top portion of the washer rack. The washers assume the position shown in FIGS. 4 and 5. Now the operator pulls trigger 323 on the handle assembly so as to bring the washer dispenser mechanism to its ready position, thereby allowing the washers to drop into the position shown in FIGS. 9 and 10. No fasteners are fired as this is done, since the driver's safety mechanism actuator rod 158 is not yet depressed.

The tool now is ready for use. The operator places one hand on hand grip 322 and the other hand on handle 306 and positions the nose of the tool against a workpiece as shown in FIG. 14. In the case of preparing molds for casting steel ingots, the workpiece consists of an insulation liner 500 which is to be fastened to the inside surface 502 of a mold 504. Little effort is required to move the tool since the rail support assembly allows horizontal freedom of movement and the automatic balancing mechanism 410 makes the tool appear substantially weightless to the operator. As the workpiece is engaged the washer holder 208 is forced inwards (as shown in FIG. 14) so it is aligned with the washer rack and a washer is thereby released from pins 226 of pivot plate 206 and advanced into the holder 208. This brings the dispenser to the fire position previously described. As this is done, safety mechanism rod 158 is simultaneously depressed by the rear side of holder 208 so that the gun is made ready to fire. Now trigger 323 is depressed, whereupon a fastener is fired from the driver. The shank of the fired fastener passes through the center hole of the washer in holder 208 and the head of the fastener engages the washer, thereby carrying the washer forward with the fastener to the workpiece. The fastener penetrates the insulation liner 500 and enters the side wall of the mold far enough for the head or the shank of the fastener to clamp the washer against the liner. The trigger is maintained in a depressed position as the driver's recoil brings the tool away from the workpiece, with front holder 208 returning to its angular position (FIG. 5) and bringing the dispenser back to the ready state. Then the trigger is released, the toe of the tool brought against the workpiece again so the dispenser returns once more to its fire position, and another fastening is made. This procedure is repeated until either the fastener or washer magazine is depleted or the work is finished.

MODIFICATIONS OF THE INVENTION

It is understood that the preferred embodiment illustrated and described herein is intended as an example and is not to be considered as limiting the scope of the present invention, since various alterations and modifications may be carried out on the illustrated embodiment without departing from the essential features of the invention. In this connection reference is had to FIGS. 16 and 17 where the washer dispenser apparatus and certain parts of the driver have been modified to illustrate another contemplated design. The modified dispenser 200A comprises a vertical rack 506, a channel 508 disposed in rack 506, a first bore 510 disposed in channel 508, and a flange 512 having a semi-circular inner surface 514 that is concentric with bore 510. Flange 512 has a hole 516. Channel 508 has a cross-section substantially the same as the groove 216 shown in washer dispenser 200 and serves to slidably constrain a plurality of washers 204 along rack 506. The inner surface 514 of flange 512 forms an end wall for channel 508 and serves to help position washers which are gravity fed from the upper part of rack 506. The curvature of surface 514 is made so that it is slightly greater than the corresponding outer dimension of washers 204 and so that its ends are flush with the sides of channel 508 as shown. A pair of magnets 518 are set in rack 506 for holding washers 204 in alignment with bore 510. A pin 520 is embedded in rack 506 along its center line in surface 514 to absorb the force of the gravity-fed washers. Bore 510 has a diameter somewhat greater than the maximum diameter of a fastener.

Driver nozzle 104 and safety mechanism actuator rod 158 are modified slightly as shown in FIG. 17. More specifically, a slot 526 is cut into nozzle 104 and rod 158 is formed with an offset 159. Rack 506 is mounted to driver 100 by screws 282 and is seated so that bore 510 is aligned with the nozzle hole 181 and the safety mechanism actuator rod is directed out through slot 516.

The modified washer dispenser is intended to operate as follows. First a plurality of washers 204 are loaded into the top of rack 506, with gravity feeding them downwards along groove 508 until the bottom washer seats against pin 520. The ends of curved surface 514 of flange 512 limit sidewise movement of the washer and thus coact with pin 520 to center the washer on the hole 510. Magnets 518 serve to hold the washer in place, with washers along the remainder of rack 506 being supported by the bottom washer. Next the fastener tool is positioned against a workpiece so that safety mechanism actuator rod 158 is pressed inwards and the driver made ready to fire. Then the trigger 323 is pulled and a fastener is fired from the driver. The fastener exits from nozzle 104 and engages the bottom washer and carries it from the rack to the workpiece. As this is done the remaining washers are dropped downwards b;y gravity until the lowest one assumes a position against stop pin 520. The tool is then ready for use once again.

Other changes are also possible. One such change might be to use one long rod to couple trigger 323 to pin 330, instead of the mechanism now employed. Another change might be to change the tools' support means to a different form. These and other changes of their type are foreseen as readily obvious to one skilled in the art.

ADVANTAGES OF THE PRESENT INVENTION

There are numerous advantages to using the present invention rather than existing tools. First, the tool is pneumatically operated and therefore avoids all the undesirable characteristics of explosive-activated drivers (.e.g. noise, recoil, smoke, safety problems, slowness of operation, etc.). Second, the tool is adapted to automatically deploy a washer from a washer magazine with each fastener, without the need to manually load a preassembled washer/pin into a holder before each fastening. Operator productivity is thereby increased. Third, the tool is provided with a handle extension to facilitate its use around hard to reach places, such as about the top of the cast iron molds previously mentioned. Fourth, the tool is provided with a hangar assembly which makes it relatively weightless to an operator. Fifth, because the flange or toe 236 is made thicker than the rest of holder 208, the latter will always be sure to be deflected to the position shown in FIGS. 11 and 14 when brought into contact with the workpiece even though the workpiece may not be fully flat. Sixth only one washer is fed at a time, thereby avoiding jamming of the tool. Seventh, the tool cannot be fired until it is engaged with a work-piece. A further advantage is that the washer dispenser may be eliminated and the magnets 242, 518 or other suitable washer retaining means may be mounted directly to the end surface of tool nozzle 104, whereby washers may be manually attached to the tool in position to be picked up by a nail as it leaves the nozzle and enters a workpiece.

The tool of FIGS. 1–13 may be modified by omitting the magnets 242 since the washers are not on the pivot plate until the latter is engaged with the workpiece. Also if after a washer drops onto the pivot plate 206, the tool is retracted from the workpiece without being fired, the washer on the pivot plate will be retained in place by gravity (note that pivot plate 206 is at an angle when it is not forced back by engagement with a workpiece). Still other advantages will be obvious to persons skilled in the art.

What is claimed is:

1. A fastener driving tool comprising:

a hollow housing having first and second opposite ends;

first end means for closing off said first end of said housing, said first end means having a first opening therein for communicating with the interior of said housing;

a hammer longitudinally disposed within said housing along an axis which extends between said first and second opposite ends and which is aligned with said first opening, said hammer being movable lengthwise within said housing and along said first opening in said first end means between a first retracted position and a second extended position;

means for driving said hammer from one to the other of its first and second positions, at least some of said means for driving said hammer being disposed within said housing;

means for positioning a fastener where it may be engaged by said hammer so as to be driven from said first opening in said first end means as said hammer is driven from its first retracted position to its second extended position; and metal washer dispenser means comprising (a) a rack having first and second opposite ends and oppositely disposed parallel guide means for slidably constraining washers in edge to edge relationship along said rack and delivering them in series at said first end of said rack, (b) a gate mechanism for individually dispensing said washers from said first end of said rack, and (c) a holder adjoining said first end of said rack and adapted to receive said washers from said rack and releasably hold said washers one at a time in front of said first opening by means of at least one magnet attached to said holder, said holder also being provided with a central aperture for alignment with said first opening in said first end means and able to pass a fastener therethrough.

2. A tool according to claim 1 wherein said holder is pivotally mounted to said rack and is adapted to receive washers from said rack only when said holder is aligned co-planar with said rack with said central aperture being aligned with said first opening.

3. A tool according to claim 2 wherein said holder is comprised of a channel and a front counterbore, said counterbore communicating with said channel and said central aperture and being large enough to accommodate a washer, and said channel being adapted to transport washers one by one from said first end of said rack to said front counterbore.

4. A fastener driving tool according to claim 1 wherein said gate mechanism comprises a pivot plate mounted in an opening in said rack at said first end of said rack and adapted to pivot on an axis perpendicular to the longitudinal axis of said rack, said pivot plate having first and second front surfaces and said front surfaces being provided with first and second stop means respectively for interfering with washers sliding along said rack as said pivot plate is pivoted so that (a) when said first stop means is advanced into the path of said washers, no washer may advance past said first stop means and said second stop means is fully withdrawn from the path of the washers, and (b) when said second stop means is advanced into the path of said washers, no washer may advance past said second stop means and said first stop means is fully withdrawn from the path of said washers.

5. A fastener driving tool according to claim 4 wherein rotation means are provided to cause said pivot plate to pivot and thereby advance said first or second stop means into the path of washers carried by said rack, said rotation means comprising first spring means extending between the holder and the pivot plate and second spring means extending between said rack and said pivot plate, whereby (1) when said holder is aligned co-planar with said rack, the force exerted by said first spring means on said pivot plate exceeds the force exerted by said second spring means on said pivot plate and said first stop means is thereby advanced into the path of said washers, (2) when said holder is not aligned co-planar with said rack, the force exerted by said second spring means on said pivot plate exceeds the force exerted by said first spring means on said pivot plate and said second stop means is thereby advanced into the path of said washers, and further including means for selectively locking said pivot plate with said first stop means in the path of washers on said rack.

6. A tool according to claim 1 wherein said tool comprises a safety mechanism adapted to prevent operation thereof, said safety mechanism comprising an actuator rod for enabling said tool, said rod being disposed so as to be forced by the holder to enable the tool when the holder is engaged with a workpiece.

7. A fastener driving tool comprising:

a hollow housing having first and second opposite ends;

first end means for closing off said first end of said housing, said first end means having a first opening therein for communicating with the interior of said housing;

a hammer longitudinally disposed within said housing along an axis which extends between said first and second opposite ends and which is aligned with said first opening, said hammer being movable lengthwise within said housing and along said first opening in said first end means between a first retracted position and a second extended position;

means for driving said hammer from one to the other of its first and second positions, at least some of said means for driving said hammer being disposed within said housing;

means for positioning a fastener where it may be engaged by said hammer so as to be driven from said first opening in said first end means as said hammer is driven from its first retracted position to its second extended position;

metal washer dispenser means comprising (a) a rack having first and second opposite ends and guide means thereon for slidably constraining washers along said rack, said rack being mounted to said first end means so that said rack extends perpendicular to said axis in order that when said housing is oriented so that said axis is horizontal, gravity will urge said washers towards said first end of said rack, (b) a gate mechanism set at said first end of said rack for individually dispensing said washers from said first end of said rack, and (c) a holder adjoining said first end of said rack and adapted to receive said washers from said first end of said rack and releasably hold said washers one at a time in front of said first opening in said first end means by means of at least one magnet mounted to said holder, said holder being pivotally mounted to said rack and adapted to receive washers from said rack only when said holder is aligned co-planar with said rack, and said holder being provided with a central aperture which is aligned with said first opening in said first end means when said holder is aligned co-planar with said rack, and said central aperture is aligned with the center hole of a washer held by said holder when a washer is received by said holder;

a safety mechanism for enabling the tool only when said holder is aligned co-planar with said rack, with said holder normally being biased away from the co-planar position but with said holder being capable of being forced into the co-planar position with said rack when said tool is engaged with a workpiece;

a handle assembly coupled to said housing for positioning said tool, said handle assembly including means thereon for activating said means for driving said hammer and said gate mechanism in a coordinated fashion; and an automatic balancing mechanism coupled to said handle so as to suspend said tool relatively weightless.

8. A fastener driving tool comprising:

a hollow housing having first and second opposite ends;

first end means for closing off said first end of said housing, said first end means having a first opening therein for communicating with the interior of said housing;

a hammer longitudinally disposed within said housing along an axis which extends between said first and second opposite ends and which is aligned with said first opening, said hammer being movable lengthwise within said housing and along said first opening in said first end means between a first retracted position and a second extended position;

means for driving said hammer from one to the other of its first and second positions, at least some of said means for driving said hammer being disposed within said housing;

means for positioning a fastener where it may be engaged by said hammer so as to be driven from said first opening in said first end means; and washer dispenser means comprising (a) a rack having first and second opposite ends and guide means within said rack for slidably constraining a plurality of washers along said rack and delivering them in series at said first end of said rack, (b) a gate mechanism for individually dispensing said washers from said first end of said rack, and (c) a holder adjoining said first end of said rack and adapted to receive said washers from said rack and hold said washers one at a time in front of said first opening so that each washer's center hole is substantially aligned with said first opening, said holder being provided with a central aperture therein able to pass a fastener therethrough, and said holder being pivotally mounted to said rack and adapted to receive washers from said rack only when said holder is aligned coplanar with said rack with said central aperture aligned with said first opening, said dispenser means also being adapted to (a) allow said fastener to engage said one washer after said fastener leaves said first opening in said first end means (b) release said one washer after said one washer is engaged by said fastener, and (c) position another washer in front of said first opening after depolyment of said one washer.

9. A fastener tool according to claim 2 wherein said holder comprises a channel and a front counterbore, said counterbore communicating with said channel and said central aperture and being large enough to accommodate a washer, and said channel being adapted to transport washers one by one from said first end of said rack to said front counterbore.

10. A fastener driving tool according to claim 8 wherein said holder is provided with at least one magnet for holding one washer firm in front of said first opening.

11. A fastener driving tool according to claim 8 wherein said gate mechanism comprises a pivot plate mounted in an opening in said rack at said first end of said rack and adapted to pivot on an axis perpendicular to the longitudinal axis of said rack, said pivot plate having first and second front surfaces and said front surfaces being provided with first and second stop means respectively for interfering with washers sliding along said rack as said pivot plate is pivoted so that (a) when said first stop means is advanced into the path of said washers, no washer may advance past said first stop means and said second stop means is fully withdrawn from the path of the washers, and (b) when said second stop means is advanced into the path of said washers, no washer may advance past said second stop means and said first stop means is fully withdrawn from the path of said washers.

12. A fastener driving tool according to claim 11 wherein rotation means are provided to cause said pivot plate to pivot and thereby advance said first or second stop means into the path of washers carried by said rack, said rotation means comprising first spring means extending between the holder and the pivot plate, a second spring means extending between said rack and said pivot plate, whereby (1) when said holder is aligned co-planar with said rack, the force exerted by said first spring means on said pivot plate exceeds the force exerted by said second spring means on said pivot plate and said first stop means is thereby advanced into the path of said washers, (2) when said holder is not aligned co-planar with said rack, the force exerted by said second spring means on said pivot plate exceeds the force exerted by said first spring means on said pivot plate and said second stop means is thereby advanced into the path of said washers, and further including means for selectively locking said pivot plate with said first stop means in the path of washers on said rack.

13. A fastener driving tool according to claim 2 wherein said rack is mounted to said first end means so that said rack extends perpendicular to said axis, in order that when said housing is oriented so that said axis is horizontal, gravity will urge said washers towards said gate mechanism.

14. A fastener driving tool according to claim 8 wherein said housing is mounted on a handle assembly for positioning said tool, and further wherein said handle assembly includes means for activating said means for driving said hammer and said gate mechanism in a coordinated fashion.

15. A fastener driving tool according to claim 14 wherein said handle assembly is mounted on an automatic balancing mechanism so as to suspend said tool relatively weightless.

16. A fastener driving tool according to claim 2 wherein said means for driving said hammer comprises a pheumatic piston mechanism.

* * * * *

UNITED STATES PATENT AND TRADEMARK OFFICE

CERTIFICATE OF CORRECTION

PATENT NO. : 4339065

DATED : July 13, 1982

INVENTOR(S) : Harry M. Haytayan

It is certified that error appears in the above-identified patent and that said Letters Patent are hereby corrected as shown below:

Claim 9, column 13, line 38, the numeral "2" should be -- 8 --.

Signed and Sealed this

*Fourteenth* Day of *September 1982*

[SEAL]

*Attest:*

GERALD J. MOSSINGHOFF

*Attesting Officer*

*Commissioner of Patents and Trademarks*